US010549440B2

(12) United States Patent
Binks et al.

(10) Patent No.: US 10,549,440 B2
(45) Date of Patent: Feb. 4, 2020

(54) RAPID POLYMER HYDRATION

(71) Applicant: Ecolab USA Inc., St. Paul, MN (US)

(72) Inventors: Richard Lee Binks, Casper, WY (US); Zachary Wilson Logan, Bar Nunn, WY (US); Cheng-Sung Huang, Naperville, IL (US); Camdon J. DePaolo, Casper, WY (US)

(73) Assignee: Ecolab USA Inc., St. Paul, MN (US)

( * ) Notice: Subject to any disclaimer, the term of this patent is extended or adjusted under 35 U.S.C. 154(b) by 179 days.

(21) Appl. No.: 15/457,936

(22) Filed: Mar. 13, 2017

(65) Prior Publication Data

US 2017/0259443 A1 Sep. 14, 2017

Related U.S. Application Data

(60) Provisional application No. 62/308,068, filed on Mar. 14, 2016.

(51) Int. Cl.

| | |
|---|---|
| ***B26D 1/00*** | (2006.01) |
| ***B26D 1/36*** | (2006.01) |
| ***B26D 1/38*** | (2006.01) |
| ***B26D 7/06*** | (2006.01) |
| ***F04D 29/22*** | (2006.01) |
| ***F04D 29/54*** | (2006.01) |

(52) U.S. Cl.

CPC ..... *B26D 1/0006* (2013.01); *B26D 1/36* (2013.01); *B26D 1/38* (2013.01); *B26D 7/0691* (2013.01); *B26D 2001/0046* (2013.01); *B26D 2001/0066* (2013.01); *F04D 29/22* (2013.01); *F04D 29/2288* (2013.01); *F04D 29/545* (2013.01)

(58) Field of Classification Search

CPC . B26D 1/00; B26D 1/006; B26D 1/34; B26D 1/345; B26D 1/36; B26D 1/365; B26D 1/38; B26D 1/385; B02C 18/00; B02C 18/06; B02C 18/062

USPC ..... 83/913

See application file for complete search history.

(56) References Cited

U.S. PATENT DOCUMENTS 3,722,805 A * 3/1973 Strom ..... B02C 13/13 241/189.1
4,555,064 A * 11/1985 Asano ..... B02C 7/06 241/101.4
4,570,863 A * 2/1986 Knox, Jr. ..... B02C 23/36 241/33

(Continued)

OTHER PUBLICATIONS

PCT International Search Report and Written Opinion in International Application PCT/US2017/022161, dated May 30, 2017, 13 pages.

*Primary Examiner* — Andrea L Wellington
*Assistant Examiner* — Richard D Crosby, Jr.
(74) *Attorney, Agent, or Firm* — Merchant & Gould P.C.

(57) ABSTRACT

An apparatus for cutting polymer includes a rotor having a base with a first side and a second side opposite the first side. The rotor includes an outer annular wall extending from the first side and defining a number of slots, an inner annular wall defining a number of slots and extending from the first side and surrounded by, and spaced apart from, the outer annular wall. The rotor also includes blades extending from the first side and positioned within the inner annular wall. A circular-shaped stator also defines a number of slots. At least a portion of the stator is positioned in a space between the outer annular wall and the inner annular wall of the rotor.

20 Claims, 5 Drawing Sheets

(56) References Cited

U.S. PATENT DOCUMENTS

| | | | | |
|---|---|---|---|---|
| 4,813,617 | A * | 3/1989 | Knox, Jr. | B02C 9/00 241/33 |
| 5,203,515 | A * | 4/1993 | Stoerzbach | B01F 11/0233 241/89.3 |
| 5,522,553 | A * | 6/1996 | LeClair | B02C 18/0092 241/185.6 |
| 6,402,065 | B1 * | 6/2002 | Higgins | B02C 18/0092 241/185.6 |
| 7,338,273 | B2 * | 3/2008 | Konno | B26D 1/28 425/313 |
| 2002/0104420 | A1 * | 8/2002 | Bascom | C03B 37/16 83/665 |
| 2008/0098865 | A1 * | 5/2008 | Magula | B26D 7/08 83/37 |
| 2012/0315675 | A1 * | 12/2012 | Medoff | C08H 8/00 435/99 |
| 2015/0352507 | A1 * | 12/2015 | Jeronimo | B01F 1/0011 241/41 |
| 2017/0259443 | A1 * | 9/2017 | Binks | B26D 1/0006 |

* cited by examiner

RAPID POLYMER HYDRATION

CROSS-REFERENCE TO RELATED APPLICATIONS

This application claims priority to and the benefit of U.S. Provisional Patent Applications Ser. No. 62/308,068, filed Mar. 14, 2016, entitled, "RAPID POLYMER HYDRATION," the disclosure of which is hereby incorporated by reference.

BACKGROUND

Dry polymers are typically formed by slicing polymer particles to a standard particle size of 1200 microns. Polymers formed at the standard particle size, however, may not always be desirable for a given process or application. For example, when hydrating polymers, it may be advantageous to decrease polymer particle size. Doing so may increases a particle's surface area and decrease a required amount of time to hydrate a given volume of dry polymer.

Using conventional wetting techniques, however, may result in clumping of particles that are smaller than 1200 microns. Thus, it remains desirous to develop technologies that can wet small polymer sizes while mitigating the clumping of wetted polymers.

It is with respect to these and other considerations that the technology is disclosed. Also, although relatively specific problems have been discussed, it should be understood that the embodiments presented should not be limited to solving the specific problems identified in the introduction.

SUMMARY

Embodiments include systems and methods configured to slice dry polymer and hydrate the sliced dry polymer. In embodiments, a cutting head includes an enclosed fine tooth design on both the rotor and the stator portions of a polymer slicing assembly. In this manner, the polymer may be subjected to high shear surface, which may result in improved dispersion and quicker hydration time than with conventional systems. Embodiments of the enclosed tooth design described herein also may improve robustness in the field.

In an Example 1, an apparatus comprising: a rotor having a base with a first side and a second side opposite the first side, the rotor further including: an outer annular wall extending from the first side and defining a plurality of slots, an inner annular wall defining a plurality of slots and extending from the first side and surrounded by, and spaced apart from, the outer annular wall, and blades extending from the first side and positioned within the inner annular wall. In aspects of the technology, the blades are positioned such that there rotation of the blades causes of increase pressure across the slicing head.

In an Example 2, the apparatus of Example 1, further comprising: a circular-shaped stator defining a plurality of slots, at least a portion of which is positioned in a space between the outer annular wall and the inner annular wall.

In an Example 3, the apparatus of any of Examples 1-2, wherein the base is disc shaped.

In an Example 4, the apparatus of any of Examples 1-2, wherein the outer annular wall includes a greater number of slots than the inner annular wall.

In an Example 5, the apparatus of any of Examples 3-4, wherein a height of each of the slots is the same.

In an Example 6, the apparatus of any of Examples 3-5, wherein the outer annular wall includes rectangular slots elongated in a direction perpendicular to a surface of the first side of the base and wherein the inner annular wall includes slots elongated in a direction different than the rectangular slots.

In an Example 7, the apparatus of Example 6, wherein the slots of the inner annular wall have a width that decreases as the slots extend further from the base.

In an Example 8, the apparatus of Example 6, wherein the slots of the inner annular wall have a width that remains constant as the slots extend further from the base.

In an Example 9, the apparatus of any of Examples 3-8, wherein the slots of at least one of the outer annular wall, the inner annular wall, and the stator are evenly spaced apart from each other.

In an Example 10, the apparatus of any of Examples 3-8, wherein the slots of at least one of the outer annular wall, the inner annular wall, and the stator are unevenly spaced apart from each other.

In an Example 11, the apparatus of any of Examples 1-10, wherein the rotor, rim, and hollow cylinder are integrally formed.

In an Example 12, the apparatus of any of Examples 1-11, further comprising: a shaft coupled to the base.

In an Example 13, a cutting device comprising: a rotor having a base with a first side and a second side opposite the first side, the rotor further including: an outer annular wall extending from the first side, an inner annular wall extending from the first side and surrounded by, and spaced apart from, the outer annular wall, and blades extending from the first side and positioned within the inner annular wall; and a circular-shaped stator, at least a portion of which is positioned in a space between the outer annular wall and the inner annular wall, wherein the outer annular wall, inner annular wall, and stator include slots defined therein.

In an Example 14, the cutting device of Example 13, wherein the base is disc shaped.

In an Example 15, the cutting device of Example 14, wherein the outer annular wall includes a greater number of slots than the inner annular wall.

In an Example 16, the cutting device of any of Examples 14-15, wherein a height of each of the slots is the same.

In an Example 17, the cutting device of any of Examples 14-15, wherein the outer annular wall includes rectangular slots elongated in a direction perpendicular to a surface of the first side of the base and wherein the inner annular wall includes slots elongated in a direction different than the rectangular slots.

In an Example 18, the cutting device of Example 17, wherein the slots of the inner annular wall have a width that decreases as the slots extend further from the base.

In an Example 19, the cutting device of Example 18, wherein the slots of the inner annular wall have a width that remains constant as the slots extend further from the base.

In an Example 20, the cutting device of any of Examples 14-19, wherein the slots of at least one of the outer annular wall, the inner annular wall, and the stator are evenly spaced apart from each other.

In an Example 21, the cutting device of any of Examples 14-20, wherein the slots of at least one of the outer annular wall, the inner annular wall, and the stator are unevenly spaced apart from each other.

In an Example 22, the cutting device of any of Examples 14-21, wherein the rotor, rim, and hollow cylinder are integrally formed.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1A:
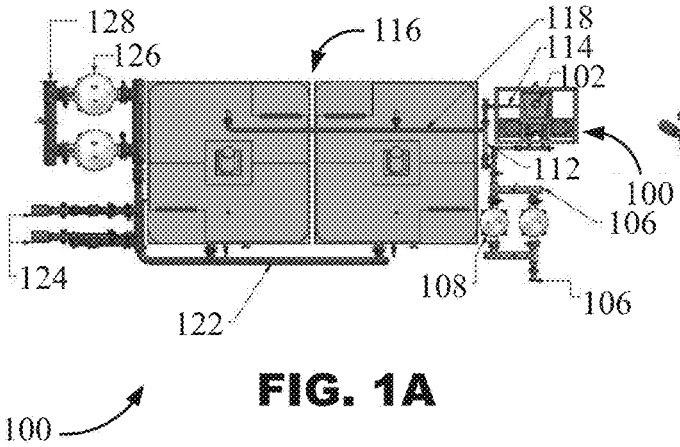
FIGS. 1A-1C show an illustrative dry polymer makedown system in accordance with embodiments of the present disclosure.

While the disclosed subject matter is amenable to various modifications and alternative forms, specific embodiments have been shown by way of example in the drawings and are described in detail below. The intention, however, is not to limit the disclosed subject matter to the particular embodiments described. On the contrary, the disclosure is intended to cover all modifications, equivalents, and alternatives falling within the scope of the disclosed subject matter as defined by the appended claims.

As the terms are used herein with respect to ranges of measurements (such as those disclosed immediately above), "about" and "approximately" may be used, interchangeably, to refer to a measurement that includes the stated measurement and that also includes any measurements that are reasonably close to the stated measurement, but that may differ by a reasonably small amount such as will be understood, and readily ascertained, by individuals having ordinary skill in the relevant arts to be attributable to measurement error, differences in measurement and/or manufacturing equipment calibration, human error in reading and/or setting measurements, adjustments made to optimize performance and/or structural parameters in view of differences in measurements associated with other components, particular implementation scenarios, imprecise adjustment and/or manipulation of objects by a person or machine, and/or the like.

DETAILED DESCRIPTION

The present disclosure involves methods, devices, and systems for rapidly hydrating dry polymers. Embodiments provide an improved cutting technology enabled by the rotor and stator design, which may facilitate rapid hydration of high and low molecular weight polymer. This can allow for reduced maturation tank volume by controlling dispersion into a high energy water stream. In some embodiments, the disclosed cutting technology may eliminate use of maturation tanks for environments and applications with tight space constraints.

In embodiments, a cutting assembly includes a slot rotor geometry using a certain profile of varying angles to efficiently cut polymer particles to small sizes, e.g., to an average particle size of approximately 75-125 microns. In some embodiments, the average particle size can be approximately 75 or 50 microns or less. The performance of the rotor shearing of the polymer particles may be adjusted by adjusting any combination of rotor gap, slot angle, slot size, rotor speed, rotor diameter, and/or the like. In embodiments, the effective cutting surface is increased, thereby allowing for more polymer cutting to take place while still maintaining conventional flow rates.

Embodiments include a rapid polymer wetting and mixing system designed to efficiently hydrate polymer at an accelerated rate. The hydrated polymer may be directed into a main flow as a slip-steam or a progressive chambered mixing tank. Embodiments of the systems and/or components described herein may be implemented in any number of various industries, including but not limited to Enhanced Oil Recovery (EOR), water treatment, paper manufacturing, food processing, mining, pharmaceutical manufacturing, and cosmetic manufacturing.

Figure 1B:
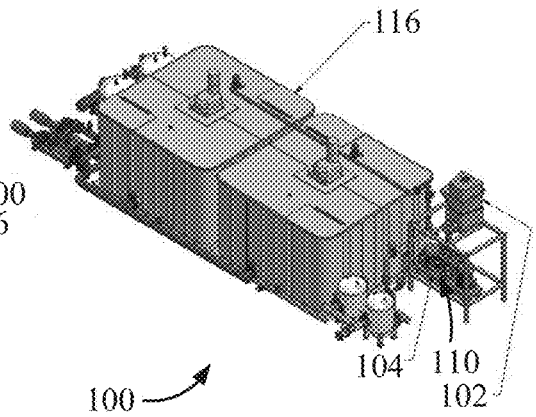
Figure 1C:
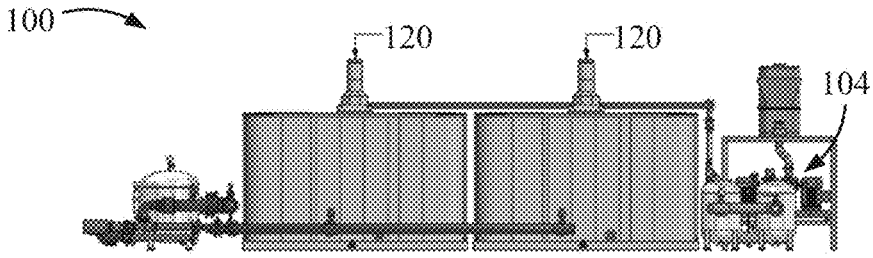

FIGS. 1A-1C depict an illustrative polymer makedown system 100, in accordance with embodiments of the disclosure. The system 100 includes a dry polymer feeding assembly 102 that provides dry polymer to a cutting assembly 104 that wets the polymer as it cuts (e.g., shears, slices, etc.) the polymer into small particles. The particles may be between approximately 75 microns and 150 microns. In embodiments, the particles may be between approximately 75 microns and 125 microns. Water for wetting the polymer is provided to the system 100 via one or more water inlets 106, and filtered using a water filtration system 108. A wetting feed 110 provides filtered water to the cutting assembly 104 for wetting the polymer. The system 100 may also include a water bypass 112 for diluting a concentrated cut polymer stream provided via a conduit 114.

The diluted polymer stream may be provided to a maturation tank assembly 116 via a conduit 118. As the polymer is maturated in the maturation tank assembly 116, it may be agitated using one or more mixing devices 120. Matured polymer may be removed from the maturation tank assembly 116, via a conduit 122, using polymer filtration pumps 124. The filtration pumps 124 may pump the matured polymer to a polymer filtration system 126. Embodiments of the system may facilitate hydration of polymer in 20 minutes or less in a tank assembly. For example, by employing embodiments of the system, including the cutting assembly 114 and the water bypass 112, polymer with an average particle size of approximately 100 microns may hydrate in 5 minutes or less in a tank assembly. The filtered matured polymer may be provided to a system for use via an outlet 128. For example, in embodiments, the outlet 128 may be coupled to an injection system for injecting the filtered matured polymer into an oil well for use in EOR.

The illustrative system 100 shown in FIGS. 1A-1C is not intended to suggest any limitation as to the scope of use or functionality of embodiments of the present disclosure. Neither should the illustrative system 100 be interpreted as having any dependency or requirement related to any single component or combination of components illustrated therein. Additionally, various components depicted in FIGS. 1A-1C may be, in embodiments, integrated with various ones of the other components depicted therein (and/or components not illustrated), all of which are considered to be within the ambit of the present disclosure. In embodiments, for example, the maturation tank system 116 may include one tank, two tanks, three tanks, or any other number of tanks. Additionally, for example, the system 100 may include computing devices, control boards, sensors, and/or the like, for controlling various aspects of its operation.

In some embodiments, polymer can be hydrated for use without using maturation tanks. For example, as mentioned above, a cutting assembly may cut polymer into an average particle size of 50 microns or less. Polymer with such dimensions may be hydrated substantially "instantaneously." This may occur where water is inputted immediately before or after to the cutting assembly. In such an embodiment, the water used to hydrate polymer is such that the hydrated polymer can be inputted into a supply line without intervening maturation tanks. In some embodiments, a water and polymer mix may be inputted to a static mixer or similar device such that the polymer is hydrated and prepared for use without use of a maturation tank.

Figure 2:
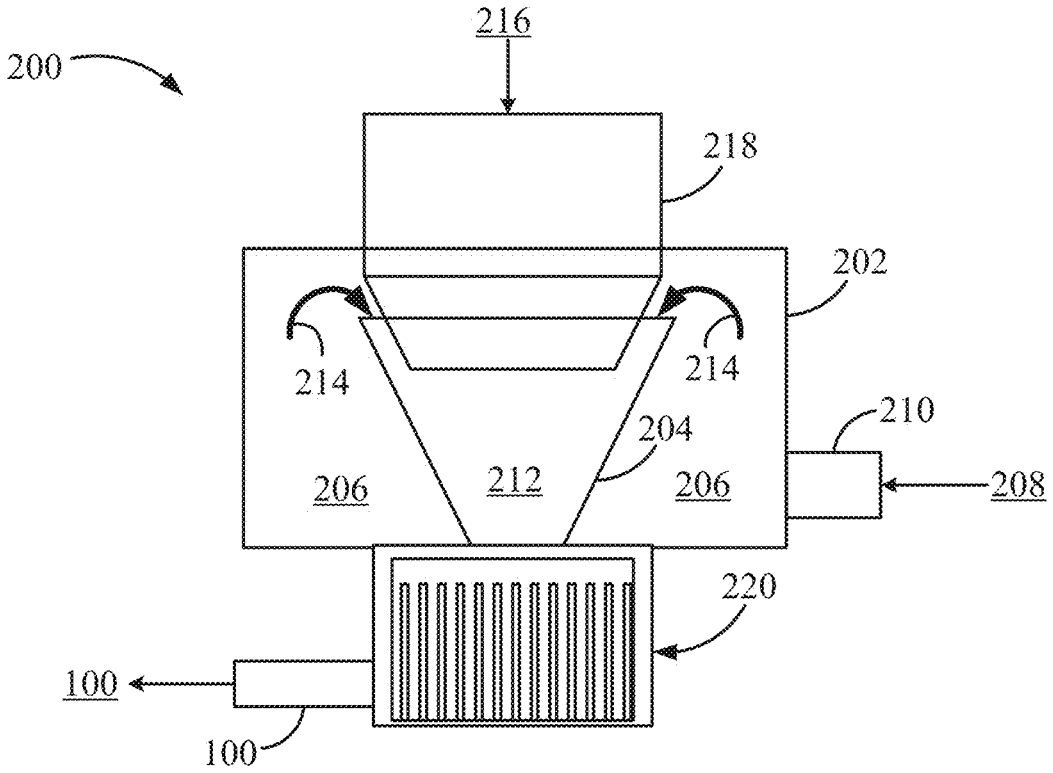
FIG. 2 is a schematic diagram of an illustrative polymer cutting assembly in accordance with embodiments of the present disclosure.

FIG. 2 is a schematic diagram of an illustrative polymer cutting assembly 200 (e.g., the cutting assembly 104 depicted in FIG. 1), in accordance with embodiments of the present disclosure. As shown in FIG. 2, the cutting assembly 200 includes a housing 202 within which is disposed a wetting funnel 204. A water chamber 206 is defined between the outside of the wetting funnel 204 and the inside of the housing 202. In this manner, water 208 provided via a water inlet 210 fills the water chamber 206 and, when it reaches the top of the wetting funnel 204, spills over the edge of the wetting funnel 204 and into the interior 212 of the wetting funnel 204, as shown by arrows 214. Dry polymer 216 is provided to the interior 212 of the wetting funnel 204 via a dispersing nozzle 218. The water 208 and polymer 216 falls into a cutting device 220, where it is sliced into smaller particles and are wet by the water 208.

The illustrative cutting assembly 200 shown in FIG. 2 is not intended to suggest any limitation as to the scope of use or functionality of embodiments of the present disclosure. Neither should the illustrative cutting assembly 200 be interpreted as having any dependency or requirement related to any single component or combination of components illustrated therein. Additionally, various components depicted in FIG. 2 may be, in embodiments, integrated with various ones of the other components depicted therein (and/or components not illustrated), all of which are considered to be within the ambit of the present disclosure.

Figure 3A:
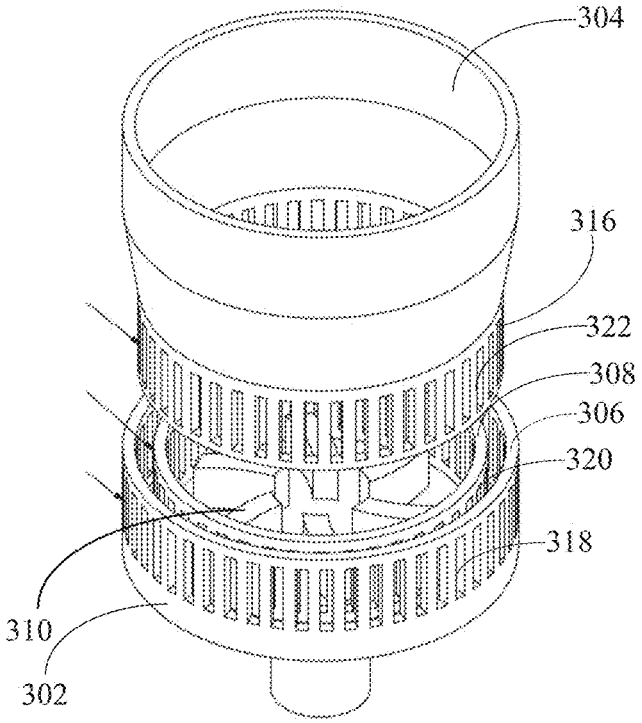
FIG. 3A shows an exploded view of a cutting device in accordance with embodiments of the present disclosure.
Figure 3B:
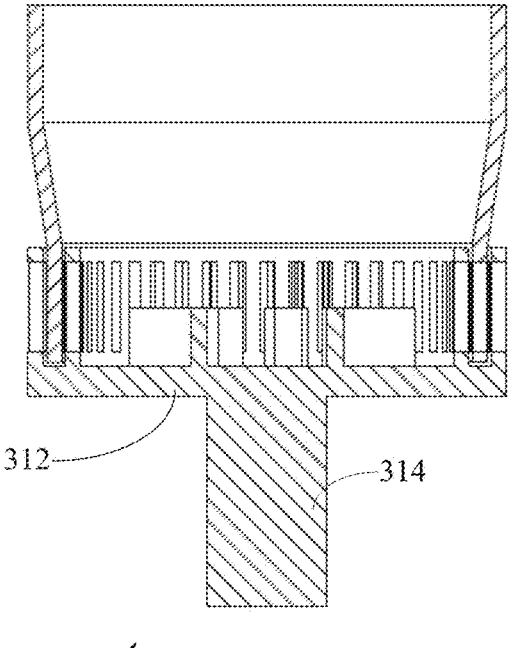
FIG. 3B shows a section view of the cutting device of FIG. 3A.

FIG. 3A shows an exploded view of a cutting device 300 (e.g., the cutting device 220 depicted in FIG. 2), in accordance with embodiments of the disclosure. The cutting device 300 includes a rotor 302 and stator 304, and FIG. 3B shows a section view of the cutting device 300. The rotor 302 is shown as having an outer annular wall 306, an inner annular wall 308, and blades 310 coupled to a first side of a base 312. A shaft 314 is coupled to second side of the base 312 opposite the first side. The outer annular wall 306 extends from the first surface of the base 312, around an outer perimeter of the base 312. The outer annular wall 306 surrounds the inner annular wall 308, which is spaced apart from the outer annular wall 306 to form an area for positioning a lower portion 316 of the stator 304. The blades 310 are positioned centrally and are surrounded by the inner annular wall 308.

In embodiments, both the outer annular wall 306 and inner annular wall 308 include slots 318 (e.g., rectangular holes) that are positioned around the outer annular wall 306 and slots 320 positioned around the inner annular wall 308. For purposes of this application, unmodified use of the term "slot" refers to an aperture having an entire circumference defined by material. For example, an unmodified use of the term "slot" would not include open-ended spaces between teeth. In some applications, for example, when using polymer cutting devices utilizing teeth-like structures instead of "slots," polymer deposits can accumulate at the first side of the base 312 between the first side and ends of teeth. The slots 318, 320 are shown as being elongated in a direction perpendicular to a planar surface of the first side of the base 312. The lower portion 316 of the stator 304 is shown as being formed as a hollow cylinder and also including slots 322 positioned around the lower portion 316 of the stator 304. FIG. 3B shows the stator 304 and rotor 302 in an assembled configuration. The lower portion 316 of the stator 304 is positioned within a space between the outer annular wall 306 and inner annular wall 308.

A wide variety of slot shapes and configurations may be used in addition to rectangular-shaped slots. For example, slots can be shaped as tear drops and/or can have concave and convex features for directing and cutting dry polymer as desired. The outer annular wall 306 may, in embodiments, have more slots than either of the inner annular wall 308 or the lower portion 316 of the stator 304. In some embodiments, the number and size of slots may be determined such that, at any given time, at least one pathway through the cutting device 300 remains open through the slots to reduce pulsing effects. Although the slots 318 depicted in FIGS. 3A and 3B are evenly spaced apart from one another, as are the slots 320 and 322, other configurations may be implemented in embodiments. For example, the slots 318, 320 and/or 322 may be spaced apart from each other in an uneven fashion. That is, for example, the slots 318, 320 and/or 322 may be spaced apart from each other according to a pattern or randomly. Additionally, in embodiments the slots 318 may be spaced apart according to a configuration that is different than a configuration according to which the slots 320 and/or 322 are spaced apart. As will be describe in further detail below, the rotor and stator can form slots that are shaped and dimensioned differently than each other.

Further yet, although the cutting device 300 is shown as having a rotor with two annular walls and the stator as having one, the disclosure is not limited to such configurations. For example, in some embodiments, both the stator and rotor have two annular walls each forming a row of slots. In other embodiments, the rotor has two annular walls and the stator has three annular walls all of which form rows of slots.

In some embodiments, slots have a width ranging from approximately 500 and 3000 microns. For example, in embodiments where the rotor has two annular walls and the stator has three annular walls, a width of slots formed in each wall may decrease from wall to wall where the inner-most wall or walls have slots that are wider than slots formed in the other walls. For example, the inner-most walls may have slots with a width of approximately 3000 microns, the middle wall have slots with a width of approximately 1500 microns, and the two most outer walls have slots with a width of approximately 500 microns. In other embodiments, the slots in each wall have the same width, for example approximately 500, 1000, 1500, or 2000 microns.

In embodiments, a distance of space between the rotor 302 and stator 304 ranges from approximately 150 to 250 microns, although other distances are appreciated.

In operation, dry polymer and water are directed through the stator 304 and towards the rotating rotor 302. The rotor 302 can rotate at a variety speeds including but not limited to 5500-7500 rpm, 6000-7000 rpm, 6250-6750 rpm, 6400-6600 rpm, and/or 6500 rpm. The rotor's blades 310 push the polymer particles toward the inner annular wall 308, causing the polymer particles to move through slots 320, 322, and 318. In some embodiments, the blades 310 range from 5000 to 15000 microns thick and are angled to create a centrifugal force that encourages polymer particles towards the slots. As the polymer particles move through the slots 320, 322, and 318, the opposite relative motion of the rotor 302 with respect to the stator 304 (note that the stator 304 may be held in a static position instead of rotating opposite the rotor 302), causes the particles to be cut (e.g., sliced) as they impinge on edges of the slots 320, 322, and 318 and, in particular, when the polymer particles are subject to a shearing effect between the edges of two opposed slots 320 and 322, or 322 and 318, produced by opposite relative motion of the rotor 302 with respect to the stator 304. In embodiments, the polymer particles may be reduced such that a range of particle sizes is 75-125 microns.

The illustrative cutting device 300 shown in FIGS. 3A and 3B is not intended to suggest any limitation as to the scope of use or functionality of embodiments of the present disclosure. Neither should the illustrative cutting device 300 be interpreted as having any dependency or requirement related to any single component or combination of components illustrated therein. Additionally, various components depicted in FIGS. 3A and 3B may be, in embodiments, integrated with various ones of the other components depicted therein (and/or components not illustrated), all of which are considered to be within the ambit of the present disclosure. In embodiments, the outer annular wall 306 and inner annular wall 308 are integrally formed with the rotor 302. In embodiments, the blades 310 are also integrally formed with the rotor 302.

Figure 4A:
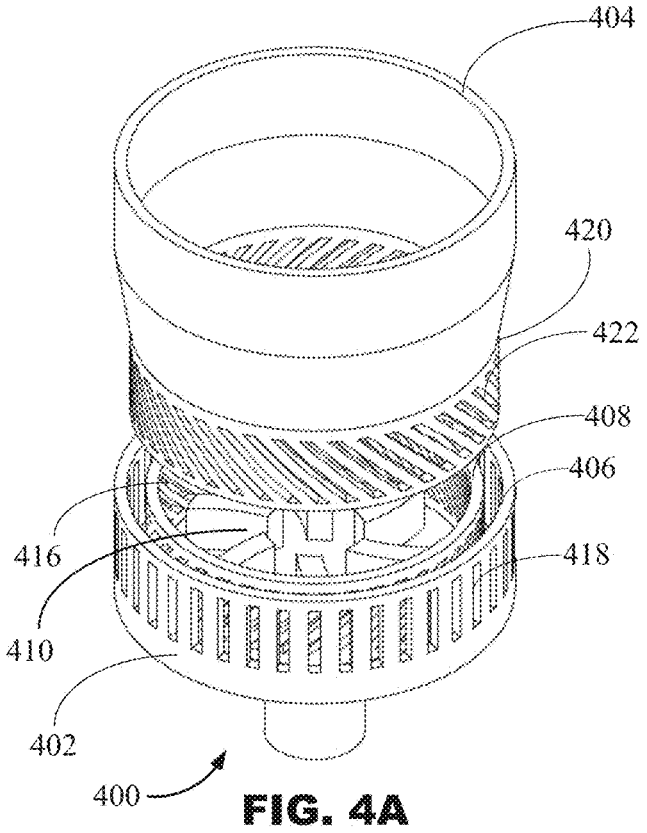
FIG. 4A shows an exploded view of another cutting device in accordance with embodiments of the present disclosure.
Figure 4B:
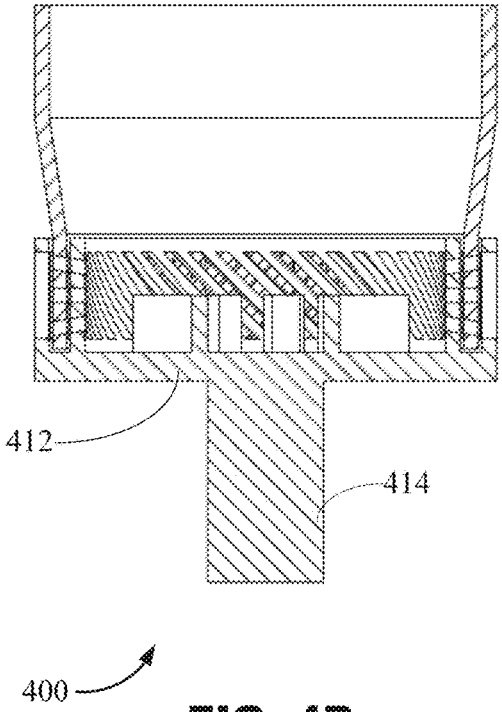
FIG. 4B shows a section view of the cutting device of FIG. 4A.

FIG. 4A shows an exploded view of another cutting device 400 (e.g., the cutting device 220 depicted in FIG. 2), in accordance with embodiments of the disclosure. The cutting device 400 includes a rotor 402 and stator 404, and FIG. 4B shows a section view of the cutting device 400. The rotor 402 is shown as having an outer annular wall 406, inner annular wall 408, and blades 410 coupled to a first side of a base 412, and a shaft 414 coupled to second side of the base 412 opposite the first side. The rotor 402 and stator 404 are constructed similarly to the rotor 302 and stator 304 of FIGS. 3A and 3B. FIGS. 4A and 4B show additional configurations of slots. Slots 416 formed in the inner annular wall 408 are rectangular shaped and slanted such that, as the slots extend away from the base 412, the slots 416 are not perpendicular to the first side of the base 412. Slots 418 formed in the outer annular wall 406 are rectangular shaped and oriented at least approximately perpendicular to the side of the base 412. In embodiments, slanted slots 418 are angled between 0 and 90 degrees. The lower portion 420 of the stator 404 is also shown with slots 422 that are rectangular shaped and slanted. However, the stator's slots 422 are slanted in a transverse relationship with the rotor's slots 416. In embodiments, this configuration may provide a more effective cutting action, though it may reduce throughput, as the openings allowing passage of polymer particles may be smaller than those associated with vertically oriented sets of slots.

Figure 5A:
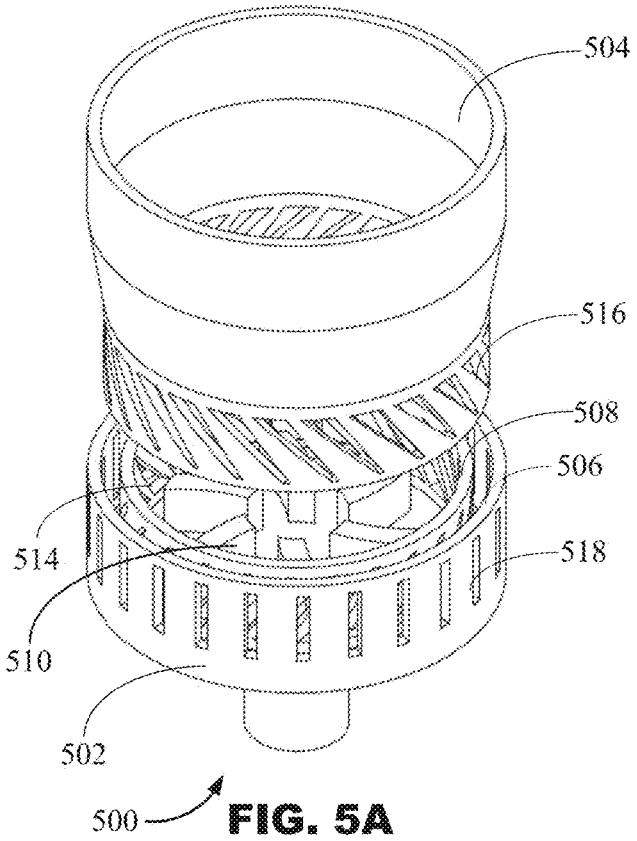
FIG. 5A shows an exploded view of another cutting device in accordance with embodiments of the present disclosure.
Figure 5B:
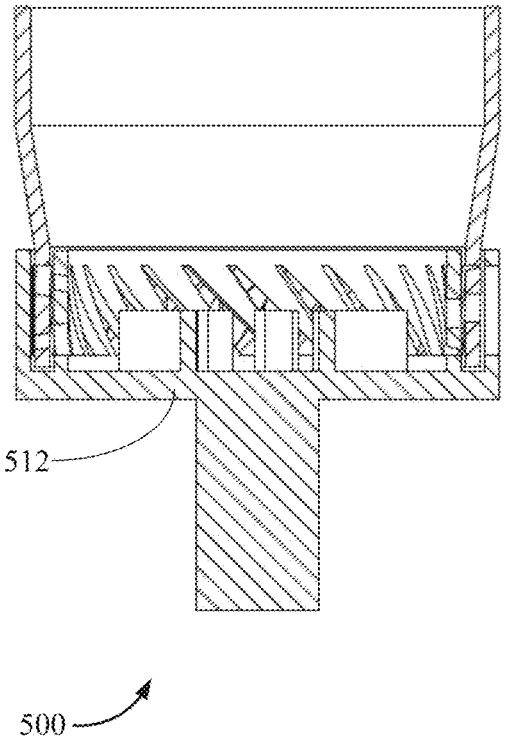
FIG. 5B shows a section view of the cutting device of FIG. 5A.

FIG. 5A shows an exploded view of another cutting device 500 (e.g., the cutting device 220 depicted in FIG. 2), in accordance with embodiments of the disclosure. The cutting device 500 includes a rotor 502 and stator 504, and FIG. 5B shows a section view of the cutting device 500. The rotor 502 is shown as having an outer annular wall 506, an inner annular wall 508, and blades 510 coupled to a first side of a base 512. The rotor 502 and stator 504 may be constructed similarly to the rotor 302 and stator 304 of FIGS. 3A and 3B. FIGS. 5A and 5B show additional configurations of slots. Slots 514 formed in the inner annular wall 508 have a varying width and are slanted such that, as each of the slots 514 extends away from the base 512, the width of the slot 514 decreases, and the slots 514 are not perpendicular to the side of the base 512. In embodiments, a width of a bottom portion of the slanted slots ranges from 2500 to 3000 microns while a width of a top portion ranges from 300 to 500 microns. The stator 504 is also shown with slanted, varying-width slots 516. However, the stator's slots 516 are slanted in a transverse relationship with the rotor's slots 514 and have a width that increases as the slots extend in a direction away from the base 512. In embodiments, the orientation of the slots of the rotor and stator can be reversed such that the stator's slots have a width that decreases as the slots extend in a direction away from the base 512. Slots 518 formed in the outer annular wall 506 are rectangular shaped. In some embodiments, the slots 518 have a width that ranges from 1400 to 1750 microns. Comparing FIG. 5A with FIG. 3A, the outer annular wall 506 includes fewer slots 518, which are more spaced apart than those shown in FIG. 3A.

Various modifications and additions can be made to the exemplary embodiments discussed without departing from the scope of the present disclosure. For example, embodiments may include a rotor and stator geometry configured to create a pumping force derived from progressive and/or uniquely shaped slots that are configured to force size reduction by the natural narrowing of the shape by the rotational movement of the rotor. In embodiments, for example, the cutting device may include an overall teardrop shape using progressive non-linear curved slots, a combination of convex and concave slot designs, and/or the like. Such shapes may create a pumping effect to aid with pumping polymer. Additionally, while the embodiments described above refer to particular features, the scope of this disclosure also includes embodiments having different combinations of features and embodiments that do not include all of the above described features.

We claim:

1. An apparatus comprising:

a rotor having a base with a first side and a second side opposite the first side, the rotor further including:

an outer annular wall extending from the first side and defining a plurality of slots, an inner annular wall defining a plurality of slots and extending from the first side and surrounded by, and spaced apart from, the outer annular wall, and blades extending from the first side and positioned within the inner annular wall.

2. The apparatus of claim 1, further comprising:

a circular-shaped stator defining a plurality of slots, at least a portion of which is positioned in a space between the outer annular wall and the inner annular wall.

3. The apparatus of claim 1, wherein the base is disc shaped.

4. The apparatus of claim 1, wherein the outer annular wall includes a greater number of slots than the inner annular wall.

5. The apparatus of claim 3, wherein a height of each of the slots is the same.

6. The apparatus of claim 3, wherein the outer annular wall includes rectangular slots elongated in a direction perpendicular to a surface of the first side of the base and wherein the inner annular wall includes slots elongated in a direction different than the rectangular slots.

7. The apparatus of claim 6, wherein the slots of the inner annular wall have a width that decreases as the slots extend further from the base.

8. The apparatus of claim 6, wherein the slots of the inner annular wall have a width that remains constant as the slots extend further from the base.

9. The apparatus of claim 3, wherein the slots of at least one of the outer annular wall, the inner annular wall, and the stator are evenly spaced apart from each other.

10. The apparatus of claim 3, wherein the slots of at least one of the outer annular wall, the inner annular wall, and the stator are unevenly spaced apart from each other.

11. The apparatus of claim 1, wherein the rotor, rim, and hollow cylinder are integrally formed.

12. The apparatus of claim 1, further comprising:

a shaft coupled to the base.

13. A cutting device comprising:

a rotor having a base with a first side and a second side opposite the first side, the rotor further including:

an outer annular wall extending from the first side, an inner annular wall extending from the first side and surrounded by, and spaced apart from, the outer annular wall, and blades extending from the first side and positioned within the inner annular wall; and a circular-shaped stator, at least a portion of which is positioned in a space between the outer annular wall and the inner annular wall, wherein the outer annular wall, inner annular wall, and stator include slots defined therein.

14. The cutting device of claim 13, wherein the base is disc shaped.

15. The cutting device of claim 14, wherein the outer annular wall includes a greater number of slots than the inner annular wall.

16. The cutting device of claim 14, wherein the outer annular wall includes rectangular slots elongated in a direction perpendicular to a surface of the first side of the base and wherein the inner annular wall includes slots elongated in a direction different than the rectangular slots.

17. The cutting device of claim 16, wherein the slots of the inner annular wall have a width that decreases as the slots extend further from the base.

18. The cutting device of claim 17, wherein the slots of the inner annular wall have a width that remains constant as the slots extend further from the base.

19. The cutting device of claim 14, wherein the slots of at least one of the outer annular wall, the inner annular wall, and the stator are unevenly spaced apart from each other.

20. The cutting device of claim 14, wherein the rotor, rim, and hollow cylinder are integrally formed.

* * * * *